US006033248A

United States Patent [19]

Lyons

[11] Patent Number: 6,033,248

[45] Date of Patent: Mar. 7, 2000

[54] LIGHT BULB SOCKET STRUCTURE

[76] Inventor: Herb Lyons, 7360 S. 2172 West, West Jordan, Utah 84084

[21] Appl. No.: 08/927,341

[22] Filed: Sep. 11, 1997

[51] Int. Cl.[7] ..... H01R 13/00

[52] U.S. Cl. ..... 439/257; 439/384; 439/667; 313/318.03; 313/318.04

[58] Field of Search ..... 439/253, 254, 439/256, 257; 362/226; 313/318.04, 318.03

[56] References Cited

U.S. PATENT DOCUMENTS

| | | | |
|---|---|---|---|
| D. 347,620 | 6/1994 | Henrici | D13/34 |
| 2,191,336 | 2/1940 | Carroll | 439/257 |
| 3,676,835 | 7/1972 | Holly | 439/257 |
| 4,915,667 | 4/1990 | Tobias-Pader | 439/257 |
| 4,975,813 | 12/1990 | Chen | 362/226 |
| 5,171,292 | 12/1992 | Ortiz | 439/253 |
| 5,380,214 | 1/1995 | Ortega | 439/253 |

*Primary Examiner*—Ashok Patel

[57] ABSTRACT

A new POP-IN BULB for INSERTING AND REMOVING A LIGHT BULB WITHOUT NEED OF TWISTING AND SCREWING. The inventive device includes a cylindrical casing having an open upper end, a closed lower end and a cylindrical side wall therebetween. A pair of vertically disposed springs are secured to an interior surface of the closed lower end of the casing at a central location thereof. A pair of generally L-shaped support brackets are positioned in a facing relationship and are pivotally secured to an interior surface of the cylindrical side wall of the casing a diametrically opposed relationship. The support brackets are spaced so as to receive a base of a light bulb therebetween. A pair of cam levers are provided having an electrical contact disposed therebetween. The cam levers are coupled with the vertically disposed springs with the electrical contact positioned between the vertically disposed springs. The cam levers are in contact relationship with lower extents of the L-shaped support brackets in a working orientation. A pair of power wires are coupled with the electrical contact and with one of the L-shaped support brackets.

6 Claims, 2 Drawing Sheets

LIGHT BULB SOCKET STRUCTURE

BACKGROUND OF THE INVENTION

1. Field of the Invention

The present invention relates to LIGHT BULB SOCKETS and more particularly pertains to a new POP-IN BULB for INSERTING AND REMOVING A LIGHT BULB WITHOUT NEED OF TWISTING AND SCREWING.

2. Description of the Prior Art

The use of LIGHT BULB SOCKETS is known in the prior art. More specifically, LIGHT BULB SOCKETS heretofore devised and utilized are known to consist basically of familiar, expected and obvious structural configurations, notwithstanding the myriad of designs encompassed by the crowded prior art which have been developed for the fulfillment of countless objectives and requirements.

Known prior art LIGHT BULB SOCKETS include U.S. Pat. No. 5,380,214 to Ortega, Jr.; U.S. Pat. No. 4,915,667 to Tobias-Pader; U.S. Pat. No. 4,975,813 to Chen; U.S. Pat. No. 5,171,292 to Ortiz; U.S. Pat. No. 4,548,449 to Corsetti; and U.S. Pat. No. Des. 347,620 to Henrici.

While these devices fulfill their respective, particular objectives and requirements, the aforementioned patents do not disclose a new POP-IN BULB. The inventive device includes a cylindrical casing having an open upper end, a closed lower end and a cylindrical side wall therebetween. A pair of vertically disposed springs are secured to an interior surface of the closed lower end of the casing at a central location thereof. A pair of generally L-shaped support brackets are positioned in a facing relationship and are pivotally secured to an interior surface of the cylindrical side wall of the casing a diametrically opposed relationship. The support brackets are spaced so as to receive a base of a light bulb therebetween. A pair of cam levers are provided having an electrical contact disposed therebetween. The cam levers are coupled with the vertically disposed springs with the electrical contact positioned between the vertically disposed springs. The cam levers are in contact relationship with lower extents of the L-shaped support brackets in a working orientation. A pair of power wires are coupled with the electrical contact and with one of the L-shaped support brackets.

In these respects, the POP-IN BULB according to the present invention substantially departs from the conventional concepts and designs of the prior art, and in so doing provides an apparatus primarily developed for the purpose of INSERTING AND REMOVING A LIGHT BULB WITHOUT NEED OF TWISTING AND SCREWING.

SUMMARY OF THE INVENTION

In view of the foregoing disadvantages inherent in the known types of LIGHT BULB SOCKETS now present in the prior art, the present invention provides a new POP-IN BULB construction wherein the same can be utilized for INSERTING AND REMOVING A LIGHT BULB WITHOUT NEED OF TWISTING AND SCREWING.

The general purpose of the present invention, which will be described subsequently in greater detail, is to provide a new POP-IN BULB apparatus and method which has many of the advantages of the LIGHT BULB SOCKETS mentioned heretofore and many novel features that result in a new POP-IN BULB which is not anticipated, rendered obvious, suggested, or even implied by any of the prior art LIGHT BULB SOCKETS, either alone or in any combination thereof.

To attain this, the present invention generally comprises a cylindrical casing having an open upper end, a closed lower end and a cylindrical side wall therebetween. A pair of horizontally disposed springs are secured to an interior surface of the cylindrical side wall of the casing in a diametrically opposed relationship. A pair of vertically disposed springs are secured to an interior surface of the closed lower end of the casing at a central location thereof. A pair of generally L-shaped support brackets are positioned in a facing relationship and secured to free ends of the horizontally disposed springs. Each of the support brackets have an inwardly oriented protrusion disposed on an upper end thereof. The support brackets are spaced so as to receive a base of a light bulb therebetween. A pair of cam levers are provided having an electrical contact disposed therebetween. The cam levers are coupled with the vertically disposed springs with the electrical contact positioned between the vertically disposed springs. The cam levers are in contact relationship with lower extents of the L-shaped support brackets in a working orientation. A pair of power wires are coupled with the electrical contact and with one of the L-shaped support brackets.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new POP-IN BULB apparatus and method which has many of the advantages of the LIGHT BULB SOCKETS mentioned heretofore and many novel features that result in a new POP-IN BULB which is not anticipated, rendered obvious, suggested, or even implied by any of the prior art LIGHT BULB SOCKETS, either alone or in any combination thereof.

It is another object of the present invention to provide a new POP-IN BULB which may be easily and efficiently manufactured and marketed.

It is a further object of the present invention to provide a new POP-IN BULB which is of a durable and reliable construction.

An even further object of the present invention is to provide a new POP-IN BULB which is susceptible of a low cost of manufacture with regard to both materials and labor, and which accordingly is then susceptible of low prices of sale to the consuming public, thereby making such POP-IN BULB economically available to the buying public.

Still yet another object of the present invention is to provide a new POP-IN BULB which provides in the apparatuses and methods of the prior art some of the advantages thereof, while simultaneously overcoming some of the disadvantages normally associated therewith.

Still another object of the present invention is to provide a new POP-IN BULB for INSERTING AND REMOVING A LIGHT BULB WITHOUT NEED OF TWISTING AND SCREWING.

Yet another object of the present invention is to provide a new POP-IN BULB which includes a cylindrical casing having an open upper end, a closed lower end and a cylindrical side wall therebetween. A pair of vertically disposed springs are secured to an interior surface of the closed lower end of the casing at a central location thereof. A pair of generally L-shaped support brackets are positioned in a facing relationship and are pivotally secured to an interior surface of the cylindrical side wall of the casing a diametrically opposed relationship. The support brackets are spaced so as to receive a base of a light bulb therebetween. A pair of cam levers are provided having an electrical contact disposed therebetween. The cam levers are coupled with the vertically disposed springs with the electrical contact positioned between the vertically disposed springs. The cam levers are in contact relationship with lower extents of the L-shaped support brackets in a working orientation. A pair of power wires are coupled with the electrical contact and with one of the L-shaped support brackets.

Still yet another object of the present invention is to provide a new POP-IN BULB that can be produced in a range of configurations.

Even still another object of the present invention is to provide a new POP-IN BULB that features a split design for the receipt of a light bulb.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
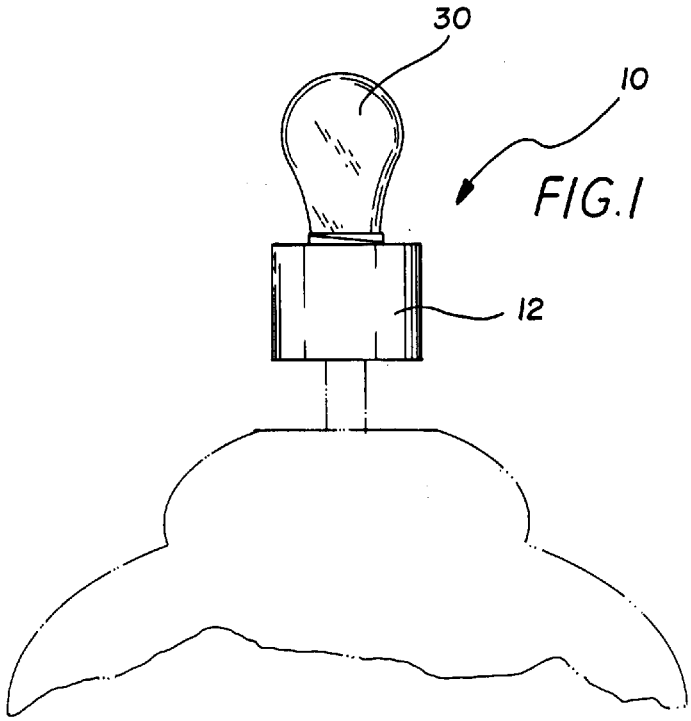
FIG. 1 is a front elevation view of a new POP-IN BULB according to the present invention.
Figure 2:
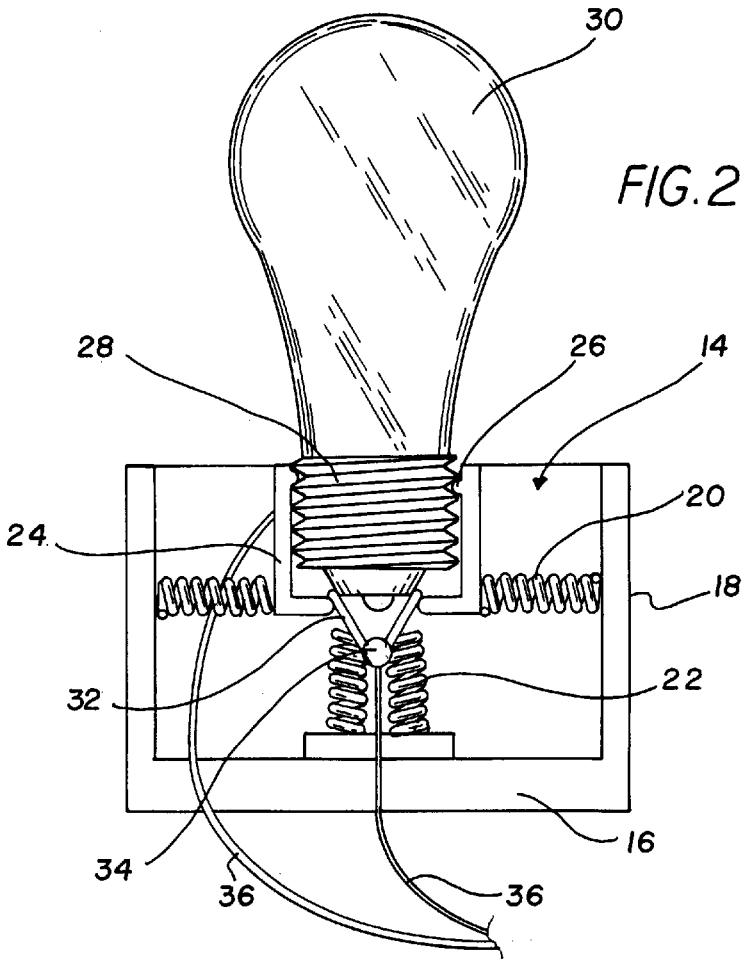
FIG. 2 is a front elevation view of the present invention illustrated in a working orientation.
Figure 3:
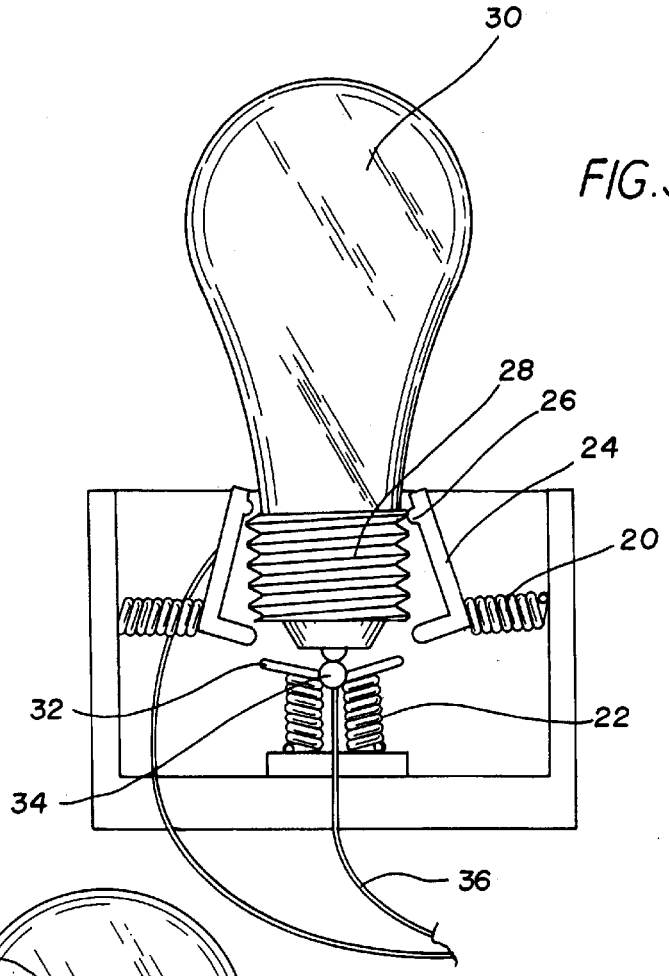
FIG. 3 is a front elevation view of the present invention illustrated in a released orientation.
Figure 4:
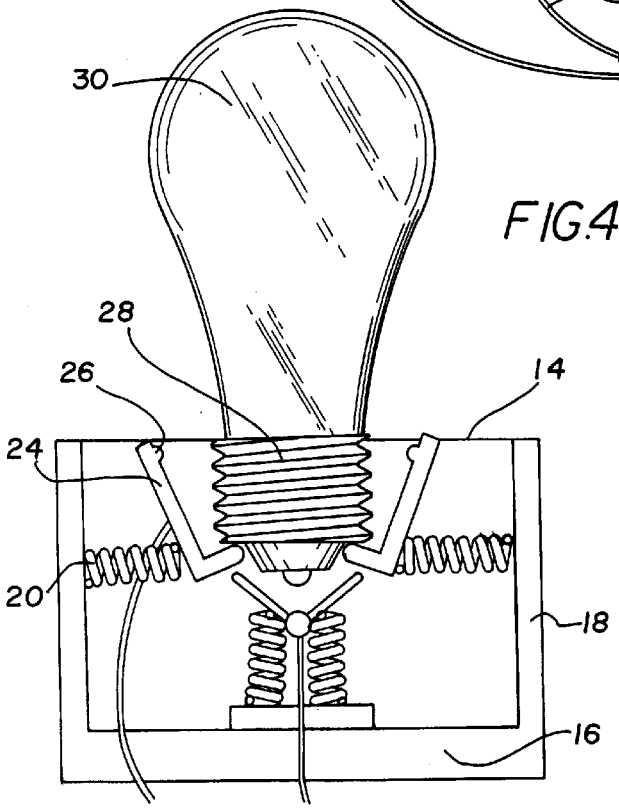
FIG. 4 is a front elevation view of the present invention illustrated in a disengaged orientation.

With reference now to the drawings, and in particular to FIGS. 1 through 4 thereof, a new POP-IN BULB embodying the principles and concepts of the present invention and generally designated by the reference numeral 10 will be described.

As best illustrated in FIGS. 1 through 4, the POP-IN BULB 10 comprises a cylindrical casing 12 having an open upper end 14, a closed lower end 16 and a cylindrical side wall 18 therebetween.

A pair of horizontally disposed springs 20 are secured to an interior surface of the cylindrical side wall 18 of the casing 12 in a diametrically opposed relationship.

A pair of vertically disposed springs 22 are secured to an interior surface of the closed lower end 16 of the casing 12 at a central location thereof.

A pair of generally L-shaped support brackets 24 are positioned in a facing relationship and secured to free ends of the horizontally disposed springs 20. Each of the support brackets 24 have an inwardly oriented protrusion 26 disposed on an upper end thereof. The support brackets 24 are spaced so as to receive a base 28 of a light bulb 30 therebetween.

A pair of cam levers 32 are provided having an electrical contact 34 disposed therebetween. The cam levers 32 are coupled with the vertically disposed springs 22 with the electrical contact 34 positioned between the vertically disposed springs 22. The cam levers 32 are in contact relationship with lower extents of the L-shaped support brackets 24 in a working orientation. Note FIG. 2.

A pair of power wires 36 are coupled with the electrical contact 34 and with one of the L-shaped support brackets 24. The power wires are coupled with electrical wiring of a lamp or the like or some other source of electrical power.

In use, the light bulb 30 is positioned between the pair of L-shaped brackets 24 with the cam levers 32 in contact with the base 28 of the light bulb 30 with the levers 32 serving as a conductor for powering the light bulb 30. Note FIG. 2. When the bulb 30 is to be removed, the user simply presses downwardly against the bias of the vertically disposed springs 22 which will push the cam levers 32 against the L-shaped support brackets 24 thereby pushing outwardly on the support brackets 24. Note FIG. 3. Pulling out the light bulb 30 will then further separate the L-shaped support brackets at their upper ends allowing for the complete removal of the light bulb from the casing 12. Note FIG. 4.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A light bulb socket structure for receiving a light bulb therein, comprising:

a cylindrical casing having an open upper end, a closed lower end and a cylindrical side wall therebetween;

a pair of horizontally disposed springs secured to an interior surface of the cylindrical side wall of the casing in a diametrically opposed relationship;

a pair of vertically disposed springs secured to an interior surface of the closed lower end of the casing at a central location thereof;

a pair of generally L-shaped support brackets positioned in a facing relationship and secured to free ends of the horizontally disposed springs, each of the support brackets having an inwardly oriented protrusion disposed on an upper end thereof, the support brackets being spaced so as to receive a base of a light bulb therebetween;

a pair of cam levers having a contact disposed therebetween, the cam levers coupled with the vertically disposed springs with the contact positioned between the vertically disposed springs, the cam levers in contact relationship with lower extents of the L-shaped support brackets in a working orientation; and a pair of power wires coupled with the contact and with one of the L-shaped support brackets.

2. A light bulb socket structure, comprising:

a cylindrical casing having an open upper end, a closed lower end and a cylindrical side wall therebetween;

a pair of vertically disposed springs secured to an interior surface of the closed lower end of the casing at a central location thereof;

a pair of generally L-shaped support brackets positioned in a facing relationship and pivotally secured to an interior surface of the cylindrical side wall of the casing a diametrically opposed relationship, the support brackets being spaced so as to receive a base of a light bulb therebetween;

a pair of cam levers having a contact disposed therebetween, the cam levers coupled with the vertically disposed springs with the contact positioned between the vertically disposed springs, the cam levers in contact relationship with lower extents of the L-shaped support brackets in a working orientation; and a pair of power wires coupled with the contact and with one of the L-shaped support brackets.

3. The light bulb socket structure of claim 2, further comprising a pair of vertically oriented springs coupling the L-shaped support brackets to the cylindrical side wall of the casing.

4. The light bulb socket structure of claim 2, wherein each of the support brackets have an inwardly oriented protrusion disposed on an upper end thereof.

5. A light bulb socket structure adapted for receiving a base portion of a light bulb therein, said light bulb socket structure comprising:

a generally cylindrical casing having a generally circular lower end and a generally cylindrical side wall upwardly extending along an outer perimeter of said lower end of said casing, said side wall of said casing having a generally circular annular upper edge defining a generally circular open upper end of said casing;

said side wall of said casing having a pair of diametrically opposing coiled compression springs inwardly extending into said casing, said springs of said side wall having opposing inner ends facing one another;

said inner ends of said springs of said side wall each having a generally L-shaped support bracket coupled thereto;

each of said support brackets having elongate upper and lower portions extending substantially perpendicular to one another;

said upper portions of said support brackets each having upper ends located in a plane adjacent said upper edge of said side wall of said casing;

said upper portions of said support brackets each having an inwardly extending upper protrusion adjacent said upper end of the respective upper portion;

said upper protrusions facing one another; and said support brackets defining a space therebetween adapted for receiving therein a base of a light bulb such that said springs of said side wall bias said support brackets towards one another to hold the base of the light bulb in said space.

6. The light bulb socket structure of claim 5, further comprising a pair of coiled compression springs upwardly extending from said lower end of said casing into said casing, each of said springs of said lower end of said casing having a top end, wherein said top end of each of said springs of said lower end of said base has a cam lever coupled thereto, said cam levers each having an inner end facing one another, and wherein a generally circular contact is interposed between said cam levers and coupled to inner ends of said cam levers.

* * * * *